United States Patent [19]

Foo

[11] 4,440,813

[45] Apr. 3, 1984

[54] SCALE MODELLING

[76] Inventor: Peter Foo, Greenwood Rd., Liverpool, England, L18 7HT

[21] Appl. No.: 455,320

[22] Filed: Jan. 3, 1983

[51] Int. Cl.[3] ..... A63H 33/04; B44F 9/04

[52] U.S. Cl. ..... 428/15; 46/12; 52/314; 156/61; 156/71; 206/223; 206/575

[58] Field of Search ..... 428/7, 15; 46/12, 16, 46/19, 21; 52/311–314; 206/233, 575; 434/74

[56] References Cited

U.S. PATENT DOCUMENTS

| | | | |
|---|---|---|---|
| 119,710 | 10/1871 | Hyatt, Jr. | 428/67 X |
| 3,594,968 | 7/1971 | Johnson | 52/311 X |
| 3,611,619 | 10/1971 | Testa | 46/20 |
| 4,061,514 | 12/1977 | Strugatz | 428/67 X |
| 4,296,154 | 10/1981 | Ibberson | 428/15 |
| 4,313,775 | 2/1982 | Moore | 428/55 X |

*Primary Examiner*—Henry F. Epstein

*Attorney, Agent, or Firm*—Alfred A. Fressola; Melvin I. Stoltz; Robert H. Ware

[57] ABSTRACT

A modelling method comprises building up walls 10 or like structures of individual wooden blocks 11 representing bricks and cardboard strips representing bed joints 12 and cross joints 13.

A model kit comprises such blocks and strips.

11 Claims, 5 Drawing Figures

SCALE MODELLING

This invention concerns scale modelling and in particular, concerns scale modelling of buildings.

Various methods and proprietary items are used to model buildings, such as constructing a framework of wood or plastics and covering the framework with embossed plastics sheet or printed paper representing brickwork, tiling etc. Other methods involve building up of structures from individual bricks which interlock.

The main disadvantage of these methods is that they do not result in wholly realistic and accurate scale models.

This invention seeks to provide a modelling technique which can result in realistic scale models of buildings.

Accordingly this invention provides a method of modelling walls and like structures wherein the walls or like structures are built up from individual blocks or strips representing bricks, breeze blocks, stones or the like and strip members representing bed and cross joints.

The blocks and strips may be fixed together by any suitable means, usually an adhesive chosen to suit the materials from which the blocks and strips are made.

Preferably the blocks are made of wood and may be coloured to represent a type of brick, breeze block or stone. The strips are preferably made of compressed carboard.

An alternative method uses strips of material to represent the bricks etc. but the strips have slots cut in them into which thin strips are inserted to represent the cross joints. A bed joint strip can be fixed to the upper or lower surface of the brick strip. To build up wall or like structure required lengths of such brick strip are cut off and struck together one on top of each other.

Other materials, may, of course, be used for making the blocks and strips, such as plastics and clay.

The method of the invention can be used to model any brick, block or stone structure including arches, squint quions and radius walls, as well as conventional straight walls and corners.

This invention also comprehends model kits comprising said blocks and strips.

These kits would also preferably include materials for modelling floors, roofs, windows, doors etc., such as machined timber sections. The kits could further include items such as scale tie wires, door and window lintels and damp proof course material which would add to the realism of the finished model.

The method and knits of the invention are envisaged as being useful for modelling in scales of 1:10 or even 1:20. However, the only restriction on the scale would be the handling of very small items.

The method and kits of the invention may not only be used by scale modellers but also by architects and the like for showing details of proposed buildings.

Features of the modelling technique of this invention will now be described, by way of example only, with reference to the accompanying drawings, in which.

Figure 1:
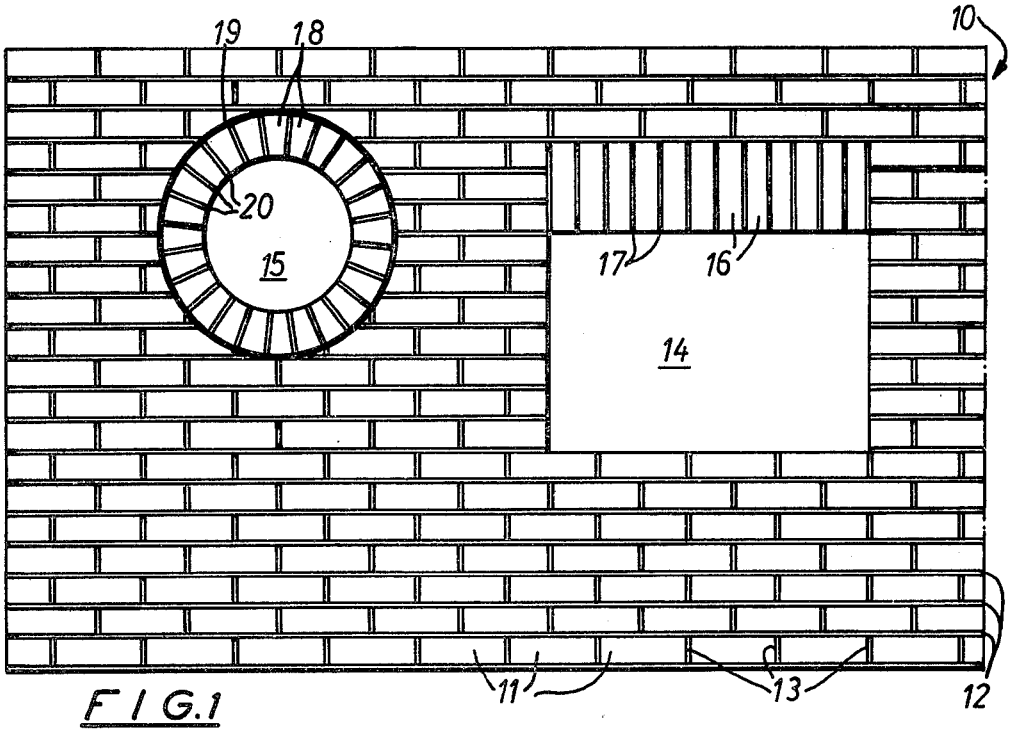
FIG. 1 shows a section of modelled wall.
Figure 2:
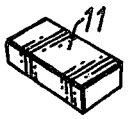
FIGS. 2 to 4 show components of the wall.
Figure 3:
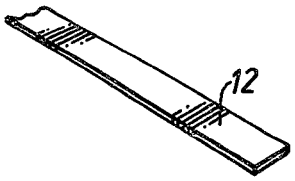
Figure 4:
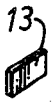

Referring to the drawings, a section of wall 10 is mainly built up from bricks 11 and horizontal strips 12 and vertical strips 13 which represent the bed and cross mortar joints. The bricks 11 are usually made of wood and the strips 12, 13 of compressed cardboard. The bricks and strips are fixed together using a suitable adhesive, such as that sold under the trade name "UHU".

Two window openings 14, 15 are shown, opening 14 being of standard rectangular shape and opening 15 being circular.

Window opening 14 is shown as topped by vertical bricks 16 separated by vertical strips 17.

The circular opening 15 is constructed from a strip 19 joined end to end to represent the outer layer of mortar, and a circle of tapered bricks 18 separated by strips 20.

Figure 5:
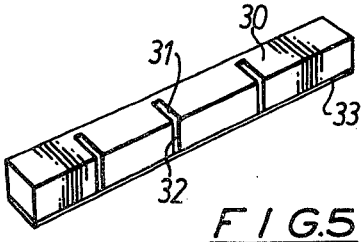
FIG. 5 shows an alternative modelling component.

Turning to FIG. 5, a strip 30 of bricks is made of a single length of wood having slots 31 therein into which have been inserted strips 32 to represent cross joints. A bed joint strip 33 is fixed to the lower surface of strip 30.

It will be appreciated that other forms of brick work, block work, stone work etc. and door and window openings can be modelled using the principle of this invention.

I claim:

1. A method of modelling walls and like structures comprising the steps of:

(1) representing a strip (30) of bricks from a elongated rectangular cross-sectionally shaped material having transverse slots (31) therein, the spaces between said slots representing bricks or the like;

(2) inserting thin rectangularly shaped strips (32) into the slots (31), so that said strips (32) represent cross joints of a simulated wall;

(3) attaching to the lower surface of strip (30) a thin elongated strip (33) dimensioned for simulating a bed-joint strip of a simulated wall; and (4) repeating steps (1) through (3) so as to form a simulated wall or like structure.

2. A method of modelling walls and the like as defined in claim 1 wherein the strips (32) inserted in slots (31) are cemented to the strip (30) along said slots (31) and wherein the strip (33) is attached to the lower surface of strip (30) by cementing.

3. A method of modelling walls and the like as defined in claim 2 wherein the strips (30) representing bricks are each fabricated from a single length of wood having transverse slots (31) formed therein, and further wherein the strips (32) representing cross-joints and the strips (33) representing bed-joints are each fabricated from compressed carboard.

4. A method of modelling walls and the like as defined in claim 3, wherein the strips (30) representing bricks or the like are colored to represent the color of brick, breeze block or stone.

5. A model kit comprising strips for representing bricks, cross joints and bed joints to be combined according to the method defined in claim 1.

6. A wall representing a model of a structural wall comprising:

(1) a plurality of longitudinal strips (30) having slots (31) formed therein perpendicular to the longitudinal dimension of the strips, the portions of the strips between slots (31) dimensioned to represent simulated brick;

(2) a plurality of strips (32) dimensioned for insertion in the slots (31) of strips (30) so as to represent simulated cross joints between said simulated bricks; and (3) a plurality of strips (33) having a longitudinal dimension substantially equal to that of the strips (30) so as to represent simulated bricks, each strip (33) attached to the lower surface of one of the strips (30), thereby representing a simulated bed-joint strip.

7. A wall as defined in claim 6 wherein the strips (32) and strips (33) are attached to strips (30) by means of cement.

8. A wall as defined in claim 7 further comprising a rectangular window opening (14) formed within an aperture defined by the cumulative placement of strips (30), (31) and (33).

9. A wall as defined in claim 8 wherein the window opening is defined at its upper termination by strips (16) dimensioned to represent vertical bricks separated by strips (17) dimensioned to represent vertical joints between said simulated vertical bricks.

10. A wall as defined in claim 8 further comprising a circular opening (15) defined within strips (30), (31) and (33) dimensioned so as to represent a circular opening within the simulated wall.

11. A wall as defined in claim 10 wherein the circular opening (15) is further defined by tapered strips (18) radiating about the center of circular opening (15) dimensioned so as represent tapered bricks and wherein strips (20) are placed between tapered bricks (18) dimensioned so as to represent cross joints between said tapered bricks.

* * * * *